US006431841B2

(12) United States Patent
Tarutani et al.

(10) Patent No.: US 6,431,841 B2
(45) Date of Patent: Aug. 13, 2002

(54) COMPRESSOR WITH A PART OF A SPRING CHAMBER IN A REAR HOUSING

(75) Inventors: Tomoji Tarutani; Yoshinori Inoue; Hiroyuki Yoshida; Masaki Ota, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/790,919

(22) Filed: Feb. 22, 2001

(30) Foreign Application Priority Data

Mar. 3, 2000 (JP) ..... 2000-058836

(51) Int. Cl.[7] ..... F04B 27/08

(52) U.S. Cl. ..... 417/269; 91/504; 91/921; 92/71; 92/153; 92/154

(58) Field of Search ..... 417/222.1, 222.2, 417/269; 91/504, 921; 92/71, 153, 154

(56) References Cited

U.S. PATENT DOCUMENTS 5,809,863 A * 9/1998 Tominaga et al. ..... 417/269
5,984,643 A * 11/1999 Ota et al. ..... 417/269
6,015,269 A * 1/2000 Ota et al. ..... 417/222.2

FOREIGN PATENT DOCUMENTS

JP A-6-117363 4/1994
JP A-7-180657 7/1995
JP A-10-89246 4/1998

* cited by examiner

*Primary Examiner*—Charles G. Freay
*Assistant Examiner*—John F Belena
(74) *Attorney, Agent, or Firm*—Woodcock Washburn LLP

(57) ABSTRACT

A compressor is provided in which the arrangement and the position of a spring chamber, in which a coil spring biasing a main shaft is accommodated, are designed and the various designs of the compressor is possible. The compressor comprises a main shaft (16), a front housing (11) which has a shaft aperture that rotatably supports the front side of the main shaft, a cylinder block (12) in which a shaft aperture is located on the rear side of the front housing and rotatably supports the rear side of the main shaft and in which cylinders are disposed on the outer circumferential side of the shaft aperture, a rear housing (13) which has a suction chamber and a discharge chamber that are disposed on the rear side of the cylinder block and can communicate with the inside of the cylinders, and a coil spring (32) which biases the main shaft from a rear side to a front side, wherein the rear housing includes a recess (13*c*) or a seat portion which defines at least a part of a spring chamber that accommodates the coil spring.

4 Claims, 4 Drawing Sheets

COMPRESSOR WITH A PART OF A SPRING CHAMBER IN A REAR HOUSING

BACKGROUND OF THE INVENTION

1. Field of the Invention

The present invention generally relates to a compressor used for an air conditioner (an air conditioning machine) and more particularly to a compressor used for an air conditioner for a vehicle (a car air conditioner).

2. Description of the Related Art

It is necessary, for provision of comfort, to use an air conditioner to adjust the temperature, humidity, air flow and air cleanness inside a room. The adjustment of temperature and the like by an air conditioner are accomplished by a compressor in a refrigerator (or a heat pump) circulating a gas and the gas performing a refrigeration cycle (or a heat-pump cycle).

Recently, weight and size reduction are required for all machines and compressors are also preferably made light and compact. More particularly, in case of a refrigerator for a car, the requirement of weight reduction and compact size are high in view of an improvement of fuel consumption, an improvement in design flexibility.

To realize a further weight reduction, a compact size of a compressor, the new ideas which are not occupied by accepted ideas are required and the capability of various designs of the compressors is effective.

However, conventionally, in a swash plate compressor 400, as shown in FIG. 4, it has been considered a matter of course that a coil spring 432, forward biasing the rear end of a main shaft 416, should be disposed in a spring chamber 440 which is formed by a valve plate 414 and a shaft aperture 441 provided in shaft center portion of a cylinder block 412. Thus problems, in which the design flexibility of a cylinder block 412, a rear housing 413 etc. are restricted and the further weight reduction, compact size, of a compressor have been prevented because of the requirement to provide a suitable space for the spring chamber 440, have arisen.

Also, in a conventional wobble type compressor 500, as shown in FIG. 5, coned disc springs 532 forward biasing the rear end side of a main shaft 516 may be disposed in a spring chamber 540 which is formed by a valve plate 514 and a shaft aperture 541 provided in a shaft center portion of a cylinder block 512. However as a coned disc spring generally has a large spring constant so that a small deflection of the coned disc spring considerably varies the actuating force thereof, precise adjustment of the actuating force is difficult. For example, if the installation position is moved slightly by an accumulation of tolerances of elements, the force which biases a main shaft forward is varied considerably. Thus when a main shaft is designed to be stably retained by using coned disc springs, it unpreferably causes problems such as an increase of manufacturing cost of a compressor.

SUMMARY OF THE INVENTION

With these above-mentioned problems being taken into account, the present invention has been developed. The purpose of the present invention is to provide a compressor in which the main shaft thereof is biased forward by a coil spring, of which the design flexibility is increased and of which weight reduction, a compact size and the like can be facilitated.

The inventor of the present invention has studied in earnest to solve the above problems and, after trial and error, has found that a recess or a seat portion, which defines a portion of a spring chamber that accommodates a coil spring forward biasing a main shaft, can be disposed in a rear housing, so that the compressor of the present invention has been developed.

That is, in the compressor of the present invention, which comprises a main shaft that receives a driving force of a power source from front side and is rotated, a front housing which has a shaft aperture that rotatably supports the front side of said main shaft, a cylinder block which has a shaft aperture, that is located on the rear side of said front housing and rotatably supports the rear side of said main shaft, and cylinders that are disposed in parallel to said shaft aperture on the outer circumferential side of said shaft aperture, a rear housing which has a suction chamber and a discharge chamber that are disposed on the rear side of said cylinder block and can communicate with the inside of said cylinders, pistons which are reciprocatably inserted into said cylinders, a suction valve which is interposed between said cylinder block and said rear housing and only allows a gas to be drawn from said suction chamber into said cylinders, a discharge valve which is interposed between said cylinder block and said rear housing and only allows the gas to be discharged from the inside of said cylinders to said discharge chamber, a swash plate which oscillates in conjunction with the rotation of said main shaft and can reciprocate said pistons, and a coil spring which is disposed on rear side of said main shaft and biases said main shaft from rear side to front side, the rear housing including a recess or a seat portion which defines at least a part of a spring chamber that accommodates the coil spring.

At least a part of a spring chamber, which accommodates the coil spring biasing the main shaft, is defined by the recess or the seat portion which is located in the rear housing, so that the flexibility of locations in which the spring chamber is positioned increases and the design flexibility of the compressor is enlarged. Thus, for example, the weight reduction, compact size and the like of the compressor and, more concretely, such as a shortening of longitudinal length thereof, can be realized more easily.

In addition, as the coil spring biases the main shaft from rear side to front side, the biasing force can be adjusted easily and the biasing force does not vary considerably due to a small movement of the installation position of the coil spring or the like. Therefore the main shaft is surely retained and an increase in the manufacturing cost of a compressor and the like does not occur.

Also, preferably, the spring chamber in the compressor communicates with a crank chamber, which is defined by the front housing and the cylinder block, and the recess or the seat portion comprises a communication passage which communicates the spring chamber to the suction chamber.

In the compressor, the crank chamber communicates with the suction chamber so as to avoid a pressure increase in the crank chamber due to blow-by of gas or the like and the communication passage between the crank chamber and the suction chamber can be simplified by locating the communication passage thereof in the spring chamber and the recess or the seat portion which defines at least a part of the spring chamber.

Further the suction chamber is more preferably defined adjacent to the outer circumferential side of the recess or the seat portion.

Because the suction chamber is located adjacent to the outer circumferential side of the recess or the seat portion, the communication passage can be further shortened, the communication passage between the spring chamber and the suction chamber can be simplified and weight reduction, a compact size, an improvement in production efficiency, can be facilitated.

Moreover the recess can be shaped as, for example, a circular hole which comprises a seat surface, that supports the end surface of the coil spring, in the bottom thereof. The seat portion may be merely a plane contact surface and may also comprise an annular groove corresponding to the coil diameter of the coil spring.

Also the compressor may be either a swash plate compressor or a wobble type compressor and also either a valuable displacement type or a fixed displacement type may be acceptable. The compressor may be used not only for a refrigeration cycle but also for a heat pump cycle. Moreover the compressor may be used for general purposes as well as for vehicular purposes. The pistons thereof may be either single-headed or double-headed. The swash plate must be oscillatable but is not necessarily rotatable such as a swash plate (a rod plate) of a wobble type compressor.

The present invention may be more fully understood from the description of the preferred embodiments of the invention set forth below, together with the accompanying drawings.

DESCRIPTION OF THE PREFERRED EMBODIMENTS (First Embodiment)

Figure 1:
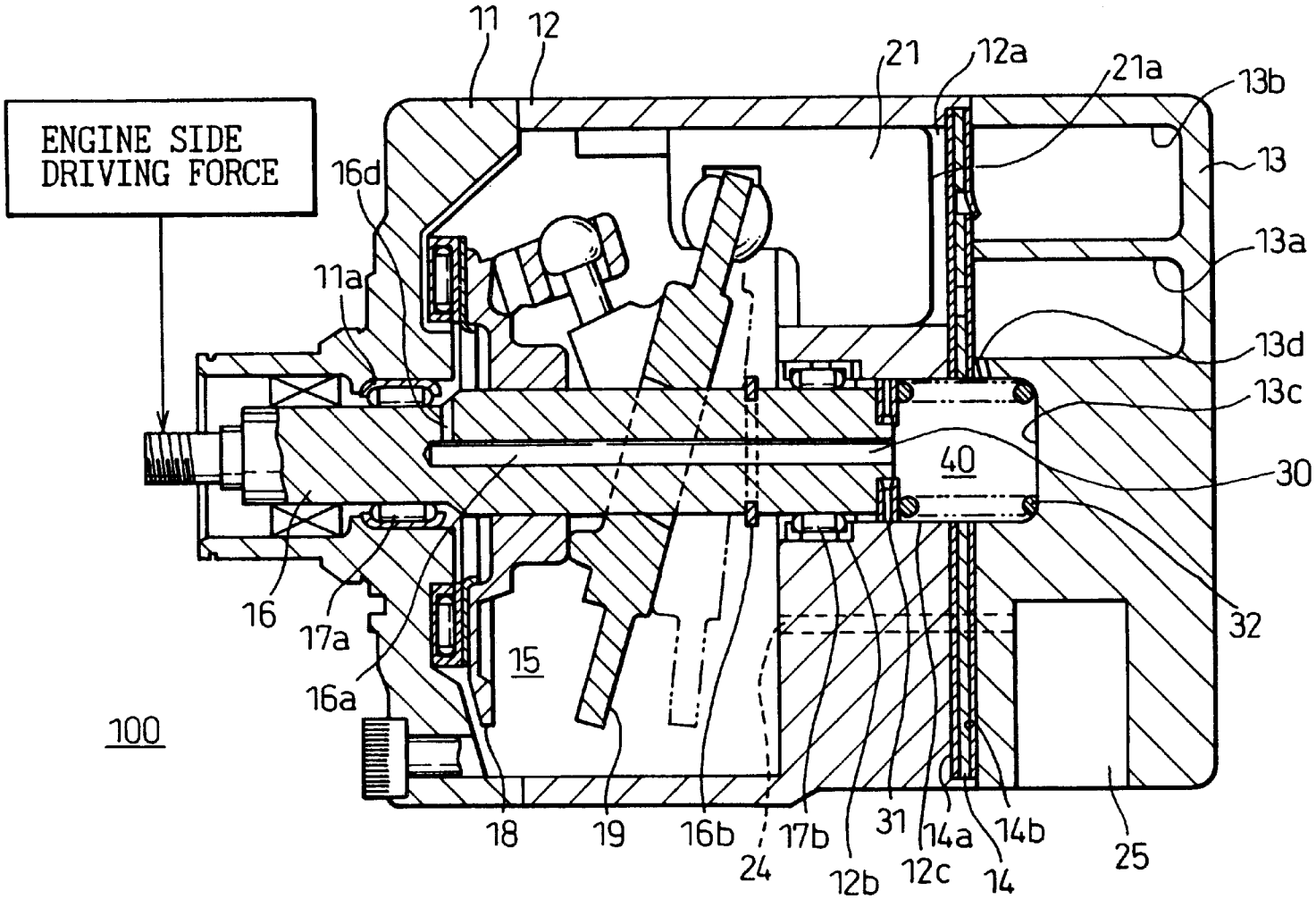
FIG. 1 is a cross-sectional drawing showing the first embodiment of the compressor according to the present invention.

A swash plate compressor 100, which is an embodiment of a compressor of the present invention, is shown in FIG. 1. The swash plate compressor 100 is a variable displacement type compressor in which single-headed pistons 21 and a swash plate 19 are incorporated.

The swash plate compressor 100 basically comprises a main shaft 16, a front housing 11, a cylinder block 12, a rear housing 13, single-headed pistons 21, a swash plate 19, a lug plate 18, a suction valve 14*a*, a discharge valve 14*b*, a valve plate 14 and a coil spring 32.

The main shaft 16 is driven by an engine via a pulley (not shown in the drawing), which is located on the front end of the swash plate compressor 100, so as to rotate. The front side of the main shaft 16 is supported by a radial bearing 17*a* and the rear side thereof is supported by a radial bearing 17*b*.

The radial bearing 17*a* is inserted in a shaft aperture 11*a* located in a shaft center portion of the front housing 11 and the radial bearing 17*b* is inserted in a shaft aperture 12*b* located in a shaft center portion of the cylinder block 12.

The cylinder block 12 is disposed on the rear side of the front housing 11 and, on the outer circumferential side of the shaft aperture 12*b*, five sets of cylinders 12*a* are disposed uniformly and annularly in parallel to the shaft aperture 12*b*. A small shaft aperture 12*c*, which is smaller diameter than that of the shaft aperture 12*b*, is formed on the rear side of the shaft center portion of the shaft aperture 12*b*. The small shaft aperture 12*c* accommodates the rear end of the main shaft 16 and a thrust bearing 31 and defines a part of a spring chamber 40, which accommodates a coil spring 32 that biases the main shaft 16 from the rear side to the front side.

Then, a crank chamber 15, which accommodates the swash plate 19, is formed in the front side of the cylinder block 12 and between the front housing 11 and the cylinder block 12.

The rear housing 13 is disposed on the rear side of the cylinder block 12 and a suction chamber 13*a*, a discharge chamber 13*b*, a recess 13*c* and a communication passage 13*b* are defined therein.

The suction chamber 13*a* and the discharge chamber 13*b* are located in correspondence to the rear side aperture (bore) of the cylinders 12*a* and can communicate with each inside of the cylinders 12*a* via the suction valve 14*a*, the valve plate 14 and the discharge valve 14*b* which are interposed between the cylinder block 12 and the rear housing 13.

However in the suction valve 14*a*, the discharge valve 14*b* and the valve plate 14, circular holes are provided at the shaft center portion so as to be able to define the spring chamber 40. The suction valve 14*a*, the discharge valve 14*b* and the valve plate 14 are positioned by a knock-out pin, which is provided between the cylinder block 12 and the rear housing 13, and are interposed and retained between the outer circumferential side walls thereof. The suction valve 14*a* and the discharge valve 14*b* are both reed valves and the suction valve 14*a* allows a refrigerant gas to be drawn only into the cylinders 12*a* from the suction chamber 13*a* and the discharge valve 14*b* allows the refrigerant gas to be discharged only from the inside of the cylinders 12*a* to the discharge chamber 13*b*. The valve plate 14 interposed between the suction valve 14*a* and the discharge valve 14*b*, becomes a core bar which supports the suction valve 14*a* and the discharge valve 14*b*.

The recess 13*c* has a circular hole shape which opens toward only front side and the bottom of the recess 13*c* forms a seat surface for a rear end of the coil spring 32. Further the spring chamber 40 is configured by the recess 13*c*, the small shaft aperture 12*c* of the cylinder block 12, the valve plate 14, which is interposed therebetween.

Thus as the spring chamber 40 is configured not only in the cylinder block 12 but also between the cylinder. block 12 and the rear housing 13, a suitable arrangement of the spring chamber 40 can be provided and it becomes possible to enlarge the design flexibility of the swash plate compressor 100.

Moreover in the rear housing 13 of this embodiment, the recess 13*c*, the suction chamber 13*a* and the discharge chamber 13*b* are defined, in this order, in the direction from the shaft center portion toward the outer circumferential side and the communication passage 13*d*, which is comprised of a small aperture that communicates the suction chamber 13*a* to the recess 13*c*, is provided by an oblique boring in a partition wall which defines the suction chamber 13*a* and the recess 13*c*.

As the suction chamber 13*a* is defined adjacent to the recess 13*c* which defines a part of the spring chamber 40, a bleed passage 30, in particular the bleed passage 30 of the rear housing 13, can be simplified and the productivity and the higher design flexibility of the swash plate compressor 100 are facilitated.

The swash plate compressor 100 comprises the bleed passage 30 which communicates the suction chamber 13*a* to the crank chamber 15. This bleed passage 30 comprises an open hole 16*d*, which communicates with the crank chamber 15 in vicinity of the radial bearing 17*a*, a shaft center passage 16*a* provided in the center of the main shaft 16, the spring chamber 40 in the center rear side of the cylinder block 12 and the communication passage 13*d*, and communicates the crank chamber 15 to the suction chamber 13*a*. By building the communication between the crank chamber 15 and the suction chamber 13*a*, the blow-by gas, which flows into the crank chamber 15 during operation, is fed back into the suction chamber 13*a* from the crank chamber 15 through the passage mentioned above. Thus the swash plate compressor 100 can continue to be operated even in a large discharge displacement operation without the crank chamber pressure Pc being abnormally raised due to the blow-by gas. In addition, in the case that the swash plate compressor 100 does not need to be driven, the pressure of the suction chamber 13*a*, the discharge chamber 13*b* and the crank chamber 15 can be maintained in a balanced condition.

Also the supply passage 24 can connect the discharge chamber 13*b* to the crank chamber 15 so as to be capable of the communicating therebetween and a displacement control valve 25 is located therebetween. The displacement control valve 25 comprises a linear solenoid valve, is controlled in accordance with the temperature of a passenger room and can adjust the pressure Pc of the crank chamber against the suction pressure Ps of refrigerant. For instance if the displacement control valve 25 is open, as shown by the double-dot line in FIG. 1, the inclination angle of the swash plate 19 decreases according to the increase in the pressure Pc of the crank chamber 15 and the discharge flow rate of the refrigerant gas decreases. On the contrary, if the displacement control valve 25 is closed, as shown by a solid line in FIG. 1, the inclination angle of the swash plate 19 increases according to the decrease of the pressure Pc of the crank chamber 15 and the discharge flow rate of the refrigerant gas increases. Thus the displacement control valve 25 increases and decreases the differential pressure, which operates on the front and the rear of the single-headed pistons 21, between the pressure Pc of the crank chamber and the inside pressure of the cylinders 12*a*, and the inclination angle of the swash plate 19 and the stroke of the single-headed pistons 21 are changed so that the discharge flow rate of the refrigerant gas can be adjusted.

The coil spring 32 is accommodated in the spring chamber 40 and is set in the distance between the bottom portion of the recess 13*c* and the thrust bearing 31. The coil spring 32 biases the main shaft 16 forward with the set load via the thrust bearing 31. This, in Spite of the vibration during driving the compressor, or the installation thereof on a vehicle, allows the main shaft 16 to be retained in a stable position and, for example, the actuation of an electromagnetic clutch installed on the main shaft 16 can be secured and an extension of the life of oil seals disposed around the main shaft 16 can be provided.

As, by the adjustment of the wire diameter, the coil diameter, numbers of winding, the wire material and the like of the coil spring 32, the spring constant, the installation length of the coil spring 32 can be facilitated to be selected more freely, in comparison with the coned disc springs, the main shaft 16 can be retained in a stable manner. In addition, even if the total length of the main shaft 16, the depth of the recess 13*c* have some manufacturing errors (tolerance), the bias force against the main shaft 16 can not be varied in large degree so that advantageously the coil spring 32 stably biases the main shaft 16.

(Second Embodiment).

Figure 2:
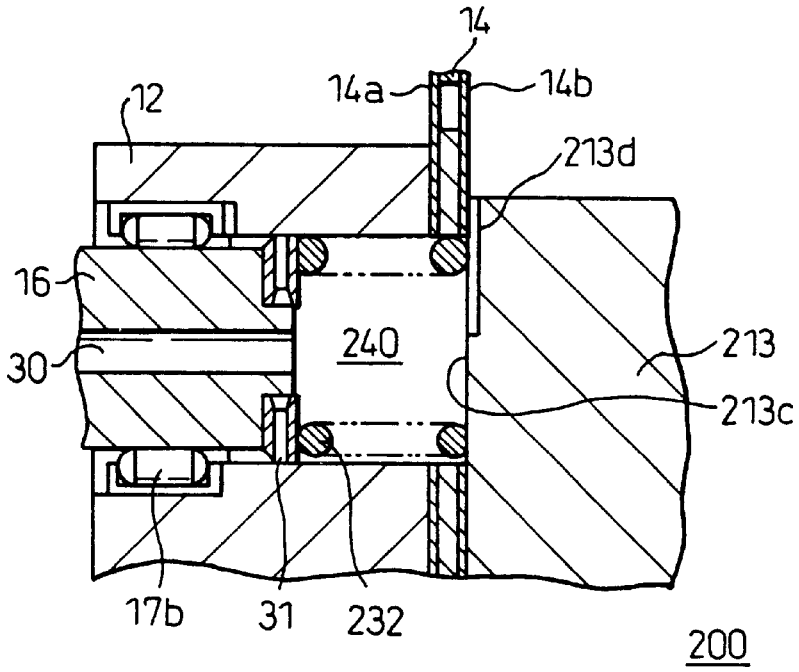
FIG. 2 is a cross-sectional drawing showing the second embodiment of the compressor according to the present invention.

A swash plate compressor 200, which is the second embodiment according to the present invention, is now shown in FIG. 2. In the FIG. 2, the modified parts relative to the swash plate compressor 100 shown in the FIG. 1 is shown by an enlarged drawing and the same components as the swash plate compressor 100 are indicated with common reference numbers.

In the swash plate compressor 200, a rear housing 213 comprises a plane portion 213*c* in its shaft center portion. The rear end surface of a coil spring 232 comes into contact with the plane portion 213*c* and the plane portion 213*c* defines a part of a spring chamber 240. Thus the plane portion 213*c* becomes a seat portion which defines a part of the spring chamber 240 that accommodates the coil spring 232.

Different from conventional compressors, in the swash plate compressor 200, as the spring chamber 240 is not defined by the suction valve 14*a*, the valve plate 14 and the like, for example, the spring chamber 240 can be formed in a larger space. Moreover if the configuration of the spring chamber 240 and the coil spring 232 can be selected suitably, the design flexibility of the swash plate compressor 100 can be further more enlarged.

(Third Embodiment)

Figure 3:
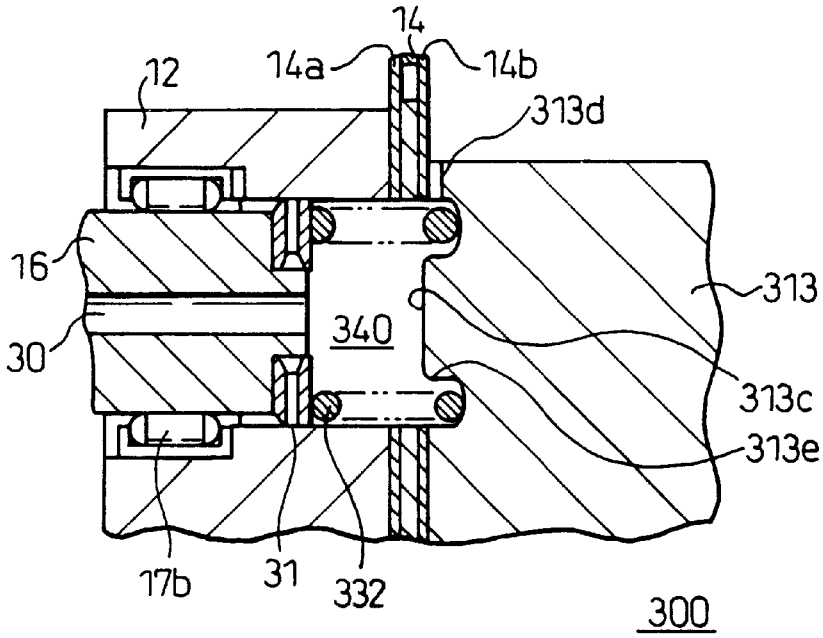
FIG. 3 is a cross-sectional drawing showing the third embodiment of the compressor according to the present invention.
Figure 4:
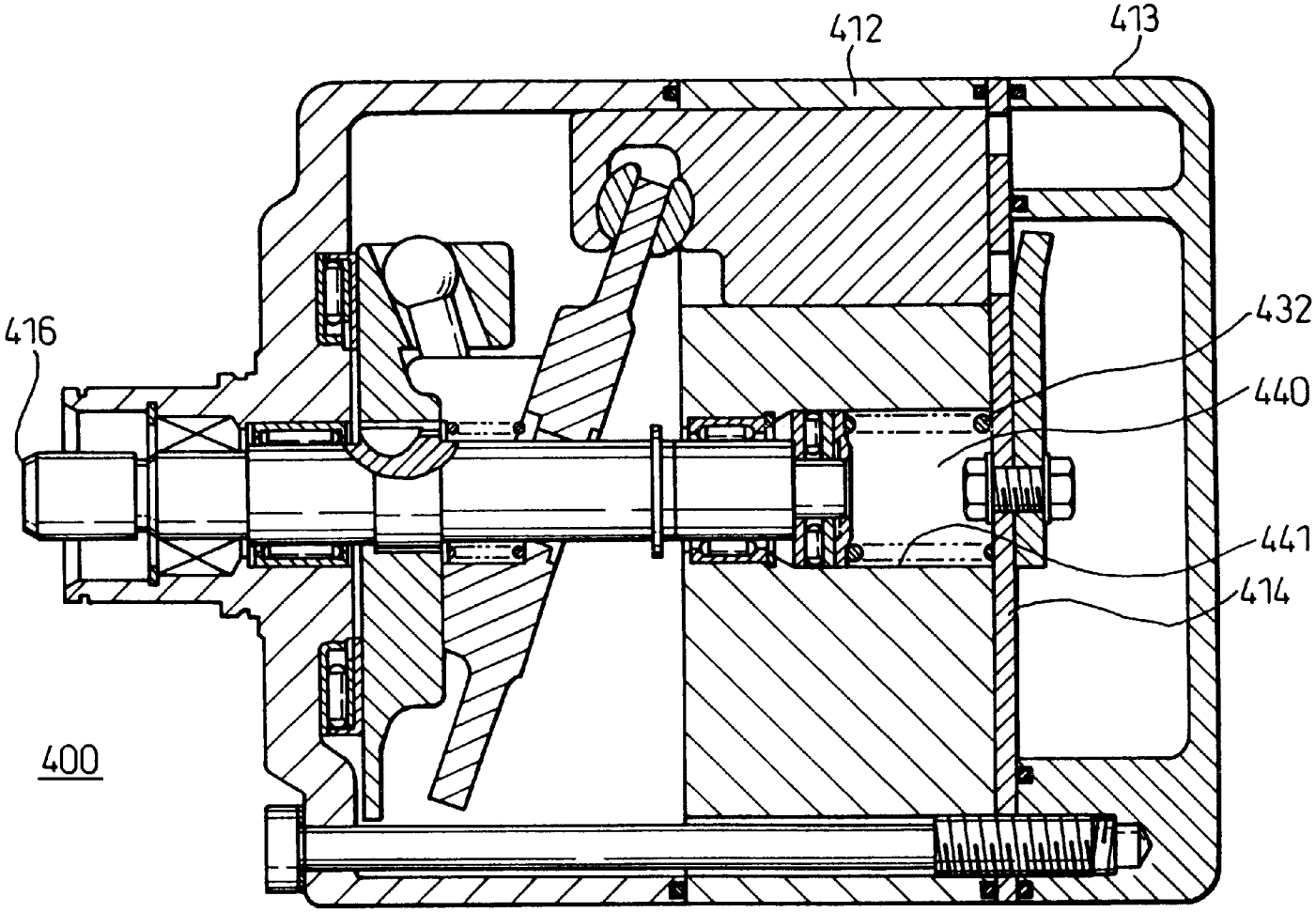
FIG. 4 is a cross-sectional drawing showing a conventional swash plate compressor.
Figure 5:
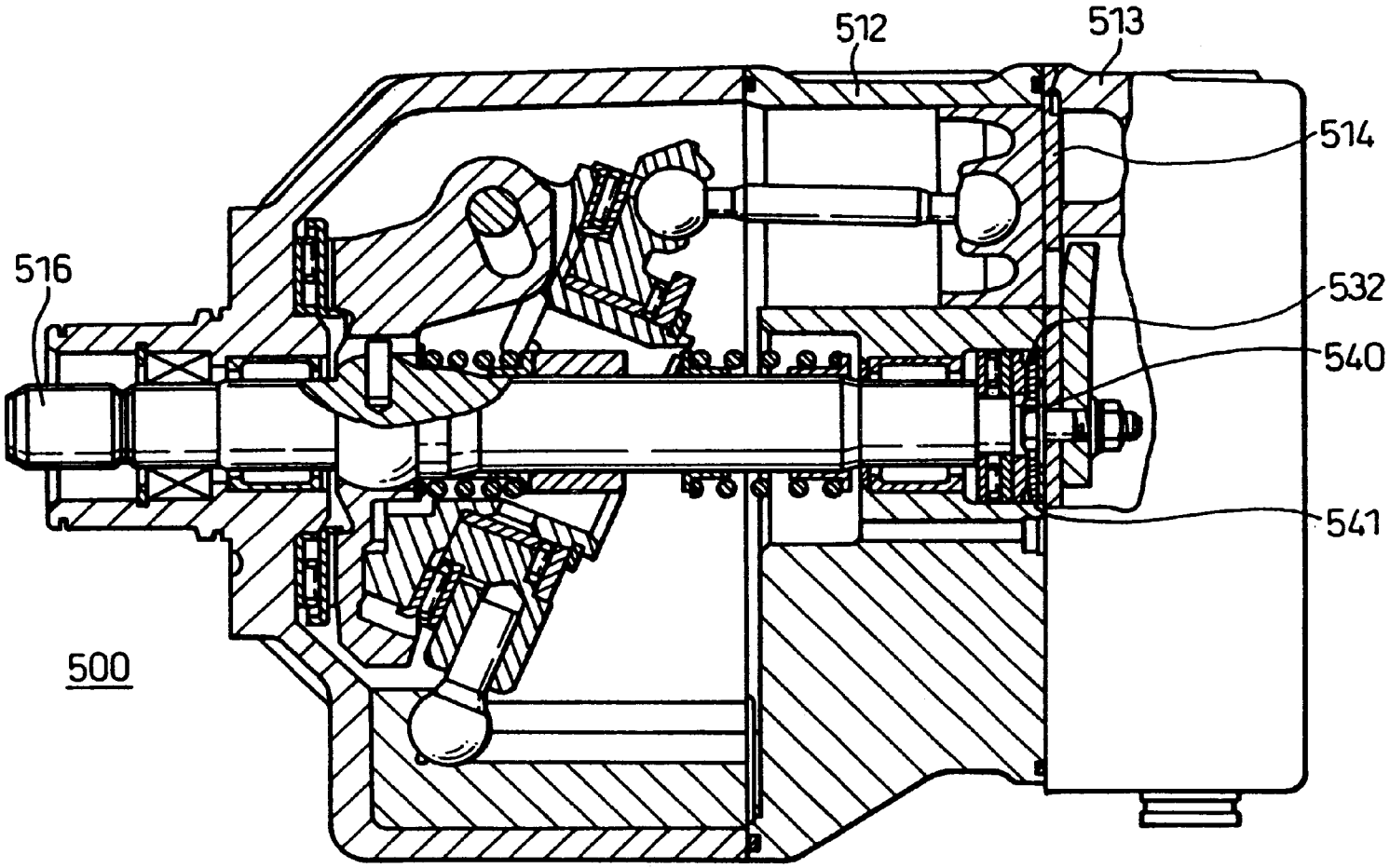
Fig.5 Prior Art
FIG. 5 is a cross-sectional drawing showing a conventional wobble type compressor.

A swash plate compressor 300, which is the third embodiment according to the present invention, is shown in FIG. 3. In the FIG. 3, the modified parts relative to the swash plate compressor 100 shown in the FIG. 1 are shown by an enlarged drawing and the same components, as in the swash plate compressor 100, are indicated with common reference numbers.

In the swash plate compressor 300, a rear housing 313 comprises a plane portion 313*c* in the shaft center portion and an annular groove 313*e* which surrounds the outer circumferential side of the plane portion 313*c*. The plane portion 313*c* and the annular groove 313*e* become a seat portion which defines a part of a spring chamber 340. In this case, the rear end of a coil spring 332 is accommodated into an annular groove 313*e* and the plane portion 313*c* present inside thereof supports the coil spring 332 from the inside. In addition, by adjusting the depth or the width of the annular groove 313*e*, various types of the coil spring 332 can be disposed therein, so that the spring constant and the set load thereof can be adjusted corresponding to the specification of the swash plate compressor 300, and the design flexibility of the swash plate compressor 300 can be increased.

Also in the swash plate compressors 200 and 300 shown in FIG. 2 and FIG. 3, each of the communication passages 213*d* and 313*d*, which communicate the suction chamber 13*a* to the spring chambers 240 and 340, is formed as a narrow groove which is located in the front side of the rear housing 213 and 313. The communication passage need not to be limited to a small aperture or a narrow groove as long as it constitutes the bleed passage 30.

According to the compressor of the present invention, the flexibility in disposing the spring chamber, in which the coil spring that biases the main shaft is. accommodated, can be increased and the design flexibility of the compressor can be enlarged. The coil spring biases the main shaft forward with a suitable load and, at the same time, for example, the shortening of the compressor length in the axial direction thereof can be facilitated.

While the invention has been described by reference to specific embodiments chosen for the purposes of illustration, it should be apparent that numerous modifications could be made thereto by those skilled in the art without departing from the basic concept and scope of the invention.

What is claimed is:

1. A compressor comprising:

a main shaft which is input from front side with a driving force from a power source so as to rotate;

a front housing, which has a shaft aperture that rotatably supports the front side of said main shaft;

a cylinder block which has a shaft aperture that is located on the rear side of said front housing and rotatably supports the rear side of said main shaft, and cylinders that are disposed in parallel to said shaft aperture on the outer circumferential side of said shaft aperture;

a rear housing which has a suction chamber and a discharge chamber that are disposed on the rear side of said cylinder block and can communicate with the inside of said cylinders;

pistons which are reciprocatably inserted into said cylinders;

a suction valve which is interposed between said cylinder block and said rear housing and only allows a gas to be drawn from said suction chamber into said cylinders;

a discharge valve which is interposed between said cylinder block and said rear housing and only allows the gas to be discharged from the inside of said cylinders to said discharge chamber;

a swash plate which oscillates in conjunction with the rotation of said main shaft and can reciprocate said pistons; and a coil spring which is disposed on the rear side of said main shaft and biases said main shaft from the rear side to the front side;

wherein, the rear housing includes a recess or a seat portion which defines at least a part of a spring chamber that accommodates the coil spring.

2. A compressor, as set forth in claim 1, wherein the spring chamber communicates with a crank chamber, which is defined by the front housing and the cylinder block, and the recess or the seat portion includes a communication passage which communicates the spring chamber to the suction chamber.

3. A compressor, as set forth in claim 2, wherein the suction chamber is defined adjacent to the outer circumferential side of the recess or the seat portion.

4. A compressor, as set forth in claim 1, further comprising a valve plate which is interposed between the cylinder block and the rear housing, wherein the valve plate has a hole at a center portion, through which the coil spring extends.

* * * * *